US010165662B2

(12) United States Patent
Fukada et al.

(10) Patent No.: US 10,165,662 B2
(45) **Date of Patent: *Dec. 25, 2018**

(54) ION GENERATOR

(71) Applicant: Koganei Corporation, Koganei-shi, Tokyo (JP)

(72) Inventors: Yoshinari Fukada, Koganei (JP); Kazuyoshi Onezawa, Koganei (JP); Yuji Takahashi, Koganei (JP)

(73) Assignee: Koganei Corporation, Tokyo (JP)

( * ) Notice: Subject to any disclaimer, the term of this patent is extended or adjusted under 35 U.S.C. 154(b) by 330 days.

This patent is subject to a terminal disclaimer.

(21) Appl. No.: 15/037,748

(22) PCT Filed: Nov. 11, 2014

(86) PCT No.: PCT/JP2014/079858

§ 371 (c)(1),
(2) Date: May 19, 2016

(87) PCT Pub. No.: WO2015/076155

PCT Pub. Date: May 28, 2015

(65) Prior Publication Data

US 2016/0302293 A1 Oct. 13, 2016

(30) Foreign Application Priority Data

Nov. 20, 2013 (JP) ..... 2013-240173

(51) Int. Cl.
*H01T 23/00* (2006.01)
*H05F 3/06* (2006.01)
(Continued)

(52) U.S. Cl.
CPC ..... *H05F 3/06* (2013.01); *H01T 19/00* (2013.01); *H01T 19/04* (2013.01); *H01T 23/00* (2013.01)

(58) Field of Classification Search
CPC ..... H05F 3/06
See application file for complete search history.

(56) References Cited

U.S. PATENT DOCUMENTS 6,462,552 B1 * 10/2002 Suzuki ..... G01R 29/24 324/457
7,586,731 B2 * 9/2009 Sato ..... H01T 19/04 361/231

(Continued)

FOREIGN PATENT DOCUMENTS

CN 1650492 A 8/2005
CN 101442870 A 5/2009

(Continued)

OTHER PUBLICATIONS

International Search Report for Application No. PCT/JP2014/079858, dated Feb. 17, 2015.

*Primary Examiner* — Stephen W Jackson
(74) *Attorney, Agent, or Firm* — McCormick, Paulding & Huber LLP

(57) ABSTRACT

Provided is an ion generator that sends out air ions generated by applying high voltage between a discharge electrode and a counter electrode, the ion generator including: an air discharge port provided in a housing of the ion generator to send ejected air toward a region between the discharge electrode and the counter electrode; and an opening portion configured to discharge the generated air ions by the ejected air, in which the counter electrode is positioned on an upstream side of the flow of the ejected air with respect to the discharge electrode.

7 Claims, 13 Drawing Sheets

(51) Int. Cl.
*H01T 19/04* (2006.01)
*H01T 19/00* (2006.01)

(56) References Cited

U.S. PATENT DOCUMENTS

| | | | | |
|---|---|---|---|---|
| 8,355,237 | B2 * | 1/2013 | Kotsuji | H01T 23/00 361/230 |
| 8,681,471 | B2 * | 3/2014 | Fukada | H01T 19/04 250/424 |
| 8,901,506 | B2 * | 12/2014 | Fukada | G01R 19/0061 250/389 |
| 9,674,934 | B2 * | 6/2017 | Fukada | H01T 23/00 |
| 2011/0199714 | A1 | 8/2011 | Kotsuji et al. | |
| 2013/0161512 | A1 | 6/2013 | Fukada | |

FOREIGN PATENT DOCUMENTS

| | | | |
|---|---|---|---|
| CN | 201663347 | U | 12/2010 |
| CN | 102228713 | A | 11/2011 |
| CN | 203193124 | U | 9/2013 |
| JP | H06208898 | A | 7/1994 |
| JP | H06275366 | A | 9/1994 |
| JP | 2009099472 | A | 5/2009 |
| JP | 2010110692 | A | 5/2010 |
| JP | 2011009235 | A | 1/2011 |
| JP | 2011-029126 | A | 2/2011 |
| JP | 2011171047 | A | 9/2011 |
| JP | 2012054088 | A | 3/2012 |
| JP | 2013-218852 | A | 10/2013 |

* cited by examiner

PRESENT INVENTION

D1: REAR DISTANCE

D2: SEPARATED DISTANCE

COMPARATIVE EXAMPLE

ION GENERATOR

CROSS-REFERENCE TO RELATED APPLICATIONS

This application is entitled to the benefit of and incorporates by reference subject matter disclosed in International Patent Application No. PCT/JP2014/079858 filed on Nov. 11, 2014 and Japanese Patent Application No. 2013-240173 filed on Nov. 20, 2013, the contents of which are hereby incorporated by reference into this application.

TECHNICAL FIELD

The present invention relates to an ion generator that blows positive air ions and negative air ions generated by corona discharge to a charged object (hereinafter, referred to as "target"), thereby neutralizing the charge of the target.

BACKGROUND ART

In order to discharge the target by blowing the air ions to the target charged with static electricity, an ion generator also referred to as an ionizer or a static eliminator is used. The ion generator used in a production line configured to perform manufacturing and assembly of electronic components is used to remove the static electricity charged to a target such as an electronic component and a manufacturing assembly jig. By removing the charged static electricity, foreign matters are prevented from adhering to the electronic component, the jig or the like due to the static electricity, or the electronic component is prevented from being destroyed by the static electricity.

As such an ion generator, there is an ion generator formed with an oblong blow-off opening with an object of discharging the wide target. For example, there is an ion generator that blows out air ions from a blow-off opening (for example, see Japan Unexamined Patent Application Publication No. H06-208898 and Japan Unexamined Patent Application Publication No. H06-275366). In Japan Unexamined Patent Application Publication No. H06-208898 and Japan Unexamined Patent Application Publication No. H06-275366, a plurality of discharge electrodes (discharge needles) is disposed along a longitudinal direction of the oblong blow-off opening at intervals. The air ions are generated between a counter electrode disposed on an outer periphery of the discharge electrode and the discharge electrode. And, compressed air is sent to the entire oblong blow-off opening from a compressor, and is ejected toward a protruding direction of the discharge electrode.

SUMMARY OF THE INVENTION

As a potential difference between the discharge electrode and the counter electrode is large, the corona discharge occurs easily. And, as a distance between the discharge electrode and the counter electrode is short, the corona discharge is liable to occur. For that reason, in the ion generator of the related art, the counter electrode is disposed on the outer periphery near a tip of the discharge electrode or a part of the outer periphery.

There is a technique of grounding the counter electrode via high resistance so that the air ions generated by the discharge electrode are not captured by the counter electrode. In this configuration, when voltage is applied to the discharge electrode, the air ions are generated by the discharge. At the same time, the capture of the air ions to the counter electrode starts. Electric current is generated by flowing of the adsorbed air ions to the counter electrode. For that reason, the potential of the counter electrode rises. As a result, the electric field intensity between the discharge electrode and the counter electrode decreases. Moreover, the air ions generated by the discharge are separated from the discharge electrode, and are easily conveyed to the target.

However, in this configuration, since the electric field intensity between the discharge electrode and the counter electrode decreases along with the adsorption of the air ions to the counter electrode, a generation amount of air ions decreases. In some cases, a balance between negative air ions and positive air ions to be generated, that is, an ion balance is degraded, which makes it difficult to sufficiently discharge the target. When the generation amount of air ions is changed, for example, in some cases, one of the positive charge or the negative charge remains even after neutralization.

The present invention is made in view of the above-described circumstances, and an object thereof is to provide an ion generator that is able to increase a conveyance amount of ion without affecting the generation amount of air ions.

In order to solve the above-described problems, according to the present invention, there is provided an ion generator that sends out air ions generated by applying high voltage between a discharge electrode and a counter electrode, the ion generator including: an air discharge port provided in a housing of the ion generator to send ejected air toward the discharge electrode, and an opening portion provided on a surface of the housing to discharge the generated air ions by the ejected air, in which the counter electrode is positioned on an upstream side of the flow of the ejected air with respect to a discharge tip of the discharge electrode.

It is preferred that the counter electrode be covered with an insulating material. Otherwise, it is preferred that the counter electrode be covered with an insulating film.

It is preferred that the discharge electrode and the counter electrode be incorporated into a discharge electrode unit, and the discharge electrode unit be freely attachable to and detachable from the housing.

It is preferred that the counter electrode be in a strip shape.

It is preferred that an air supply portion be provided in a rear side of the housing to take in outside air into a region where the air ions are generated between the discharge electrode and the counter electrode.

It is preferred that the housing be provided with a cover configured to regulate the flow of outside air incorporated between the discharge electrode and the counter electrode.

It is preferred to provide an air guide member that covers an upper front side of the air discharge port so as to send the ejected air into the opening portion.

In the ion generator according to the present invention, since the counter electrode is located on the rear side by a predetermined distance from the discharge tip of the discharge electrode, an amount of the generated air ions being adsorbed to the counter electrode decreases, therefore the discharge becomes stable and a conveyance amount of air ions also increases. In addition, the balance between positive air ions and negative air ions to be generated is satisfactory. Therefore, neutralization efficiency is improved.

DETAILED DESCRIPTION OF PREFERRED EMBODIMENTS

Figure 1:
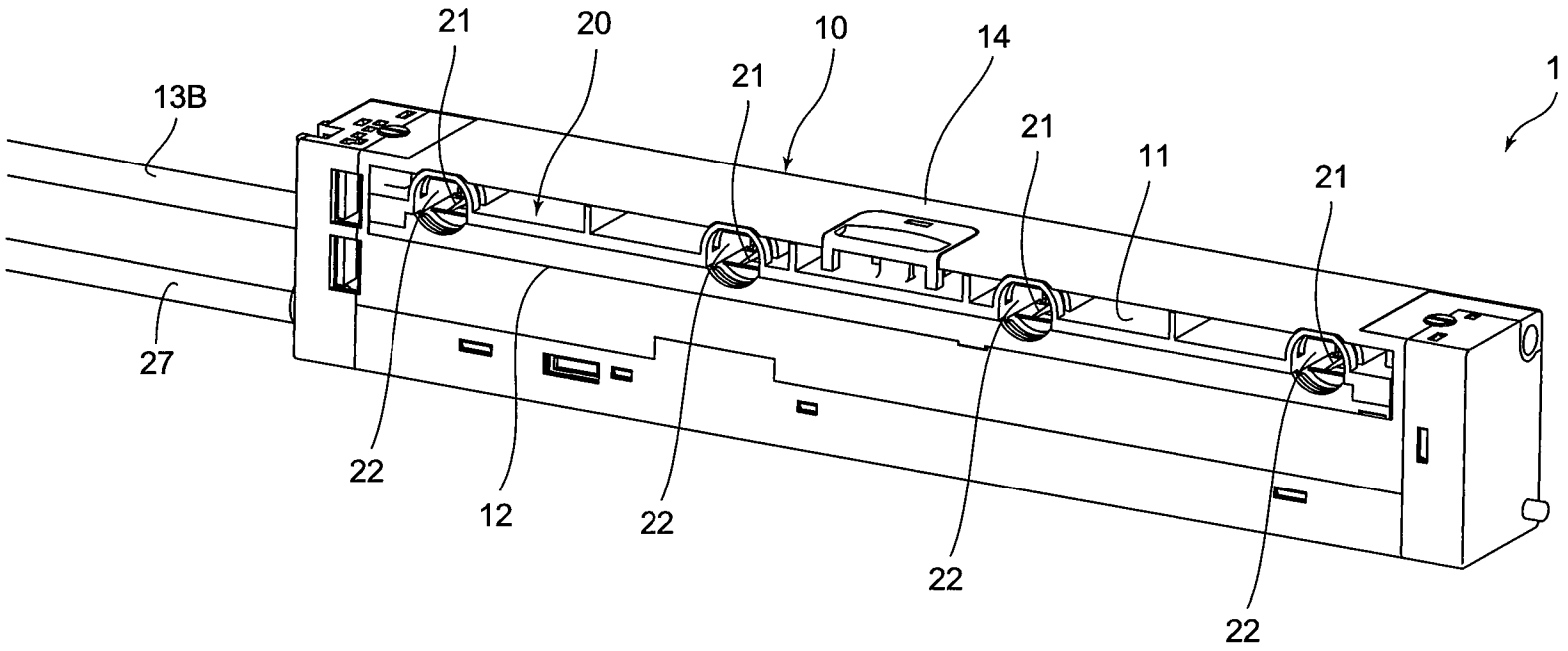
FIG. 1 is an overall perspective view in which an ion generator according to an embodiment of the present invention is viewed from a front side.

Hereinafter, one embodiment of an ion generator according to the present invention will be described in detail with reference to the drawings. In addition, a vertical direction, a lateral direction (width direction), and a depth direction used in the following description refer to directions as viewed from the front side, when a front side of FIG. 1 is assumed to be a front (surface side). In the embodiment described below, as an example of the ion generator, a wide type product that blows out the generated air ions from an oblong blow-off opening will be described. However, the present invention is not limited thereto.

Figure 8:
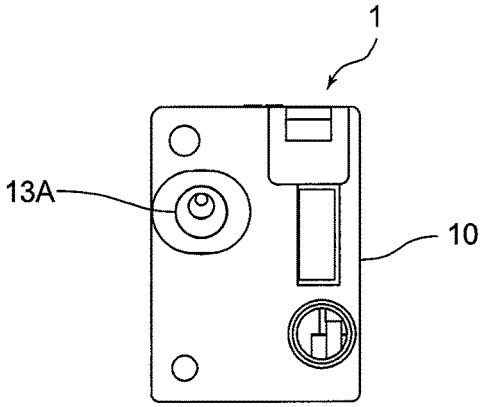
FIG. 8 is a left side view of the ion generator of FIG. 3.

In the description of the present specification, there is air of three different types. In other words, one is "ejected air". Another is "outside air". The other is "assist air". The "ejected air" is air that is supplied to an air supply port 13A (see FIG. 8) of an ion generator 1 from a compressor and is discharged from a first air discharge port 16 (see FIG. 10). The "outside air" is air that is taken from the periphery of the ion generator 1. The "assist air" is air that is discharged from a second air discharge port 31 (see FIG. 16). And, the "ion-conveying air" is air that is blown out from a blow-off opening 11 (see FIG. 1). The ion-conveying air is air obtained by mixing the ejected air and the outside air.

For example, as illustrated in FIG. 1, the ion generator 1 is formed by a housing 10 and a discharge electrode unit 20. The discharge electrode unit 20 is detachably mounted to the housing 10 from the blow-off opening 11.

Figure 3:
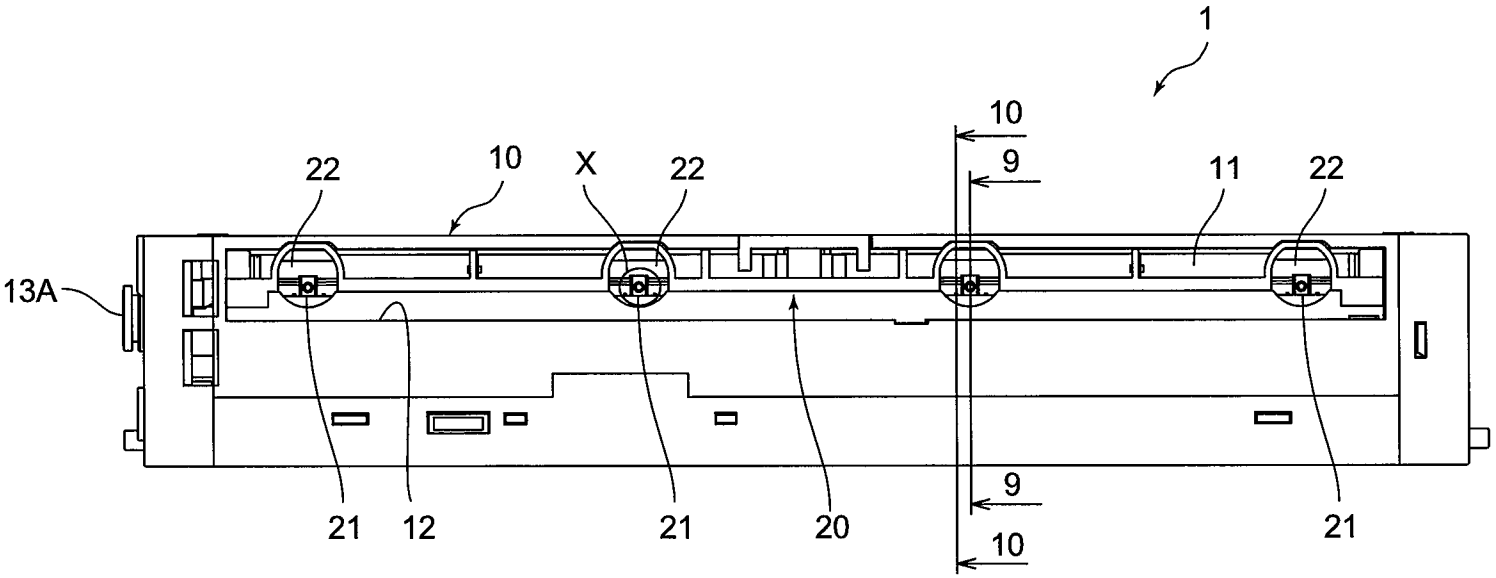
FIG. 3 is a front view of the ion generator of FIG. 1.
Figure 4:
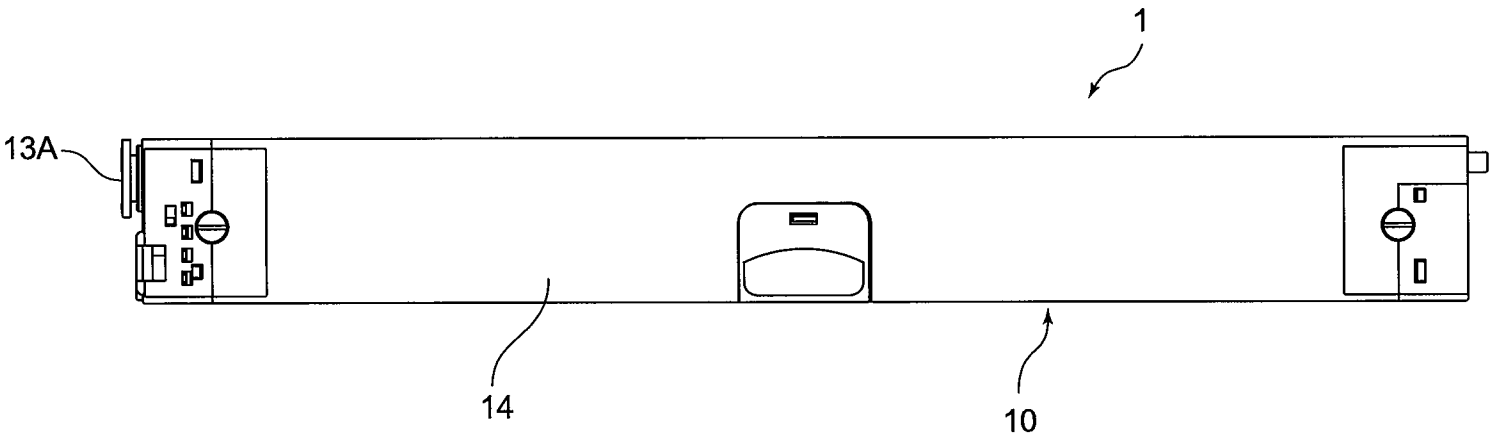
FIG. 4 is a plan view of the ion generator of FIG. 3.

The housing 10 is formed in a substantially rectangular shape that is long in the lateral direction. As illustrated in FIGS. 1 and 3, the blow-off opening 11 is formed on the upper portion of the front surface of the front side of the housing 10. The blow-off opening 11 laterally extends in the longitudinal direction of the housing 10.

Figure 9:
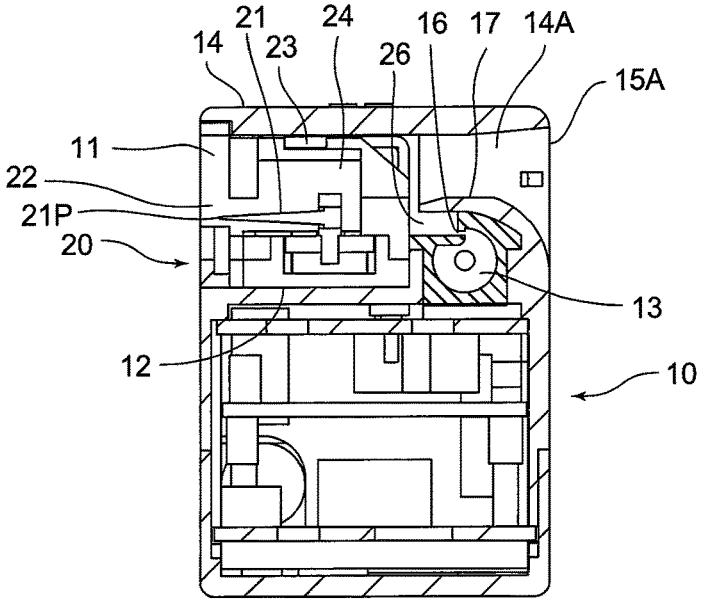
FIG. 9 is a cross-sectional view taken along the line 9-9 of FIG. 3.
Figure 11:
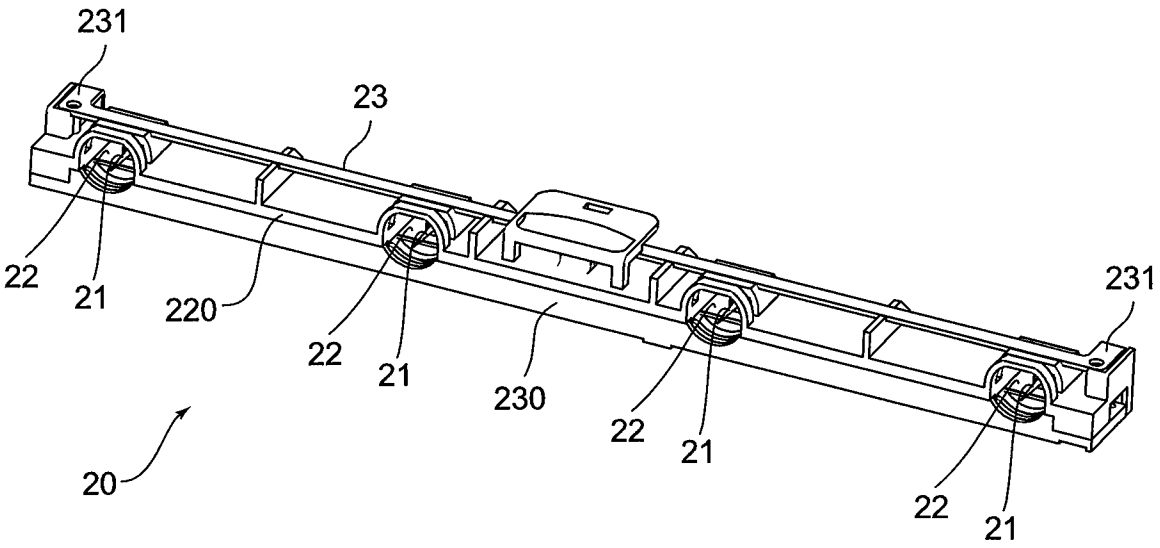
FIG. 11 is a perspective view illustrating a discharge electrode unit.

As illustrated in FIG. 9, a discharge-electrode-unit mounting-portion 12 is formed in the blow-off opening 11. The discharge electrode unit mounting portion 12 has a recessed square shape in the depth direction, and has the same length as that of the blow-off opening 11. The whole discharge electrode unit 20 illustrated in FIG. 11 is fitted into the discharge electrode unit mounting portion 12 formed in a recessed square shape. In addition, as will be described below, the discharge electrode unit 20 has a substantially rectangular shape.

Referring again to FIG. 9, a first air supply passage 13 is provided behind the discharge electrode unit mounting portion 12. The first air supply passage 13 is formed over the entire length in the lateral direction of the blow-off opening 11.

Figure 2:
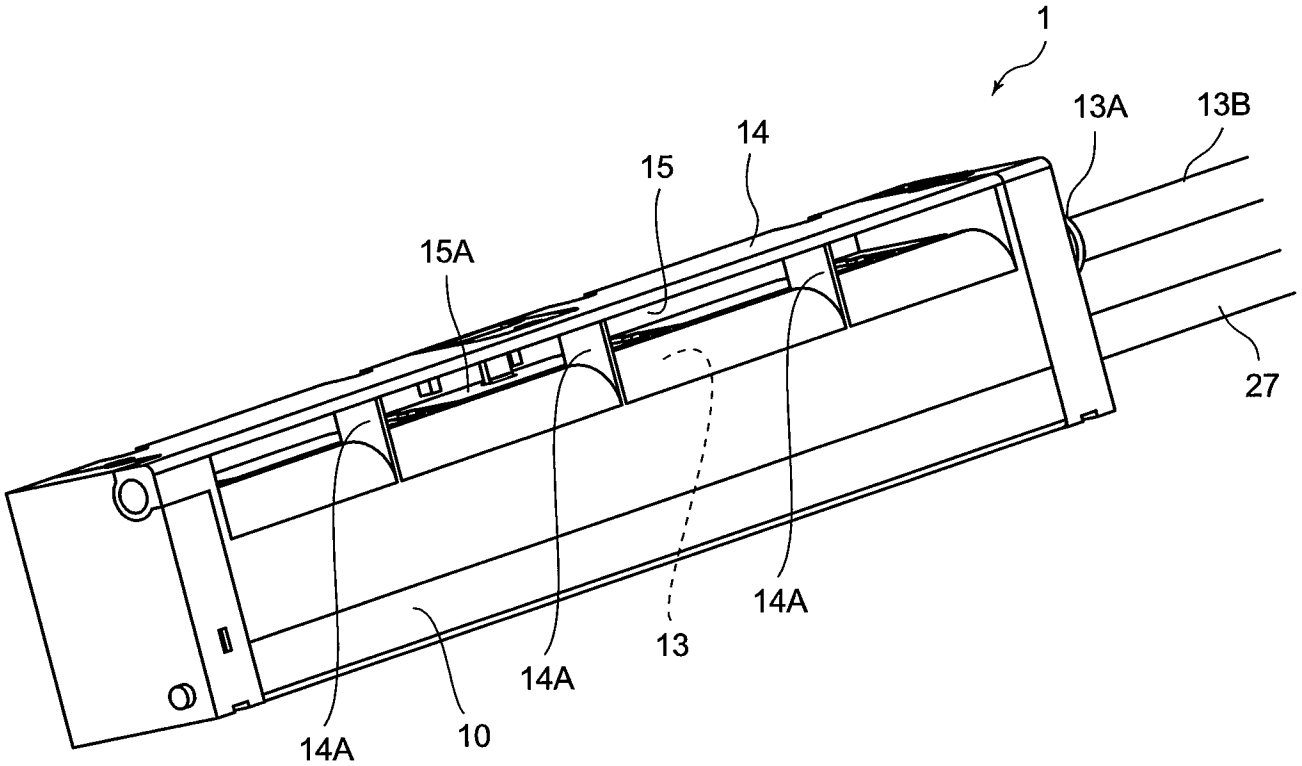
FIG. 2 is an overall perspective view in which the ion generator of FIG. 1 is viewed from a rear side.

As illustrated in FIGS. 1 and 2, the compressed air passes through a tube 13B and is supplied to the first air supply passage 13 from the air supply port 13A.

Figure 13:
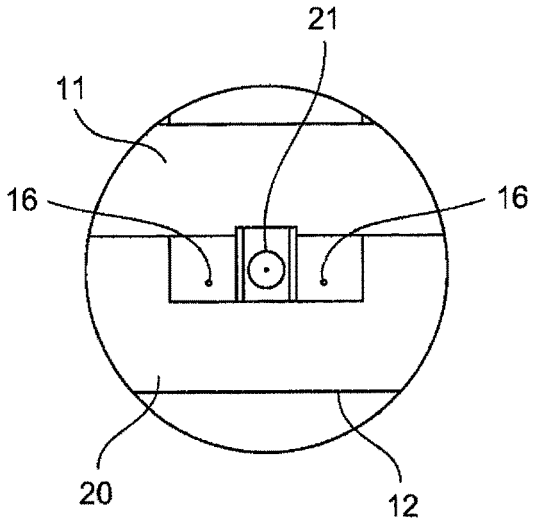
FIG. 13 is an enlarged view of an X portion of FIG. 3.
Figure 14:
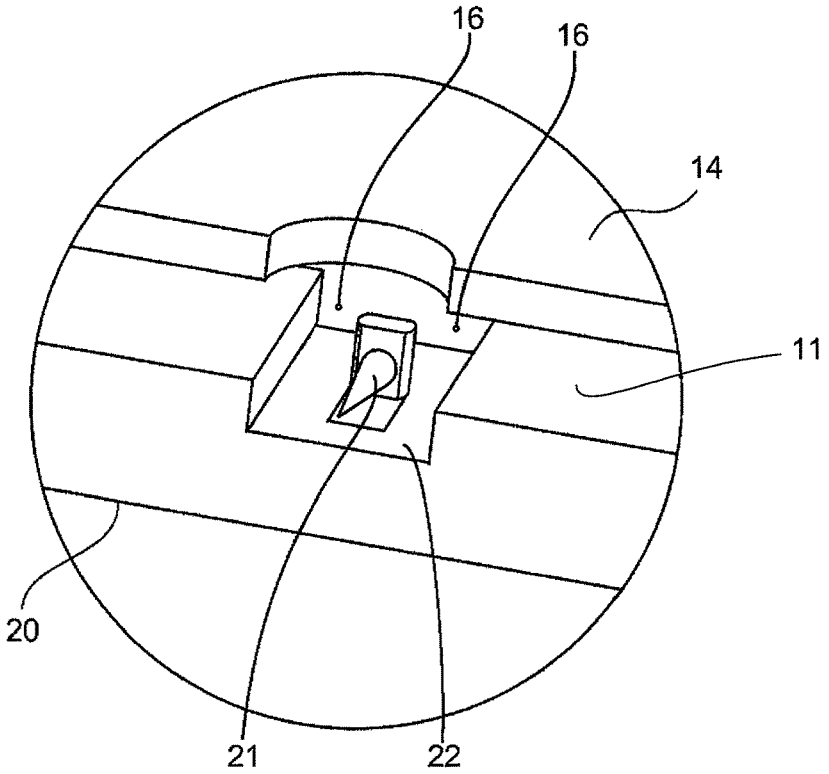
FIG. 14 is a perspective view of FIG. 13.

As illustrated in FIG. 9, a first air discharge port 16 is provided on the upper front side of the first air supply passage 13. The first air discharge port 16 discharges the air toward the rear part of the discharge electrode unit mounting portion 12 from the first air supply passage 13. As illustrated in FIGS. 13 and 14, the first air discharge ports 16 are provided on the both left and right sides of the respective discharge electrodes 21 as viewed from the blow-off opening 11 side. The ejected air is ejected forward from the first air discharge port 16 at a high speed. The working effect obtained by providing the first air discharge port 16 will be described below in detail.

Referring back o FIG. 9, an air guide member 17 is located at the upper part of the first air discharge port 16 to cover the upper front side of the first air discharge port 16. The air guide member 17 increases straightness of the ejected air blown from the first air discharge port 16. The ejected air guided by the air guide member 17 is ejected toward opening portions 22 formed in a groove shape on the periphery of the discharge electrode 21. The working effects of the ejected air guided by the air guide member 17 will be described below in detail.

Referring again to FIG. 9, a cover 14 is provided at the top of the housing 10. The cover 14 is provided above the first air supply passage 13 and the discharge electrode unit mounting portion 12, that is, on an opposite side of the discharge electrode 21 with the counter electrode 23 interposed therebetween.

Figure 5:
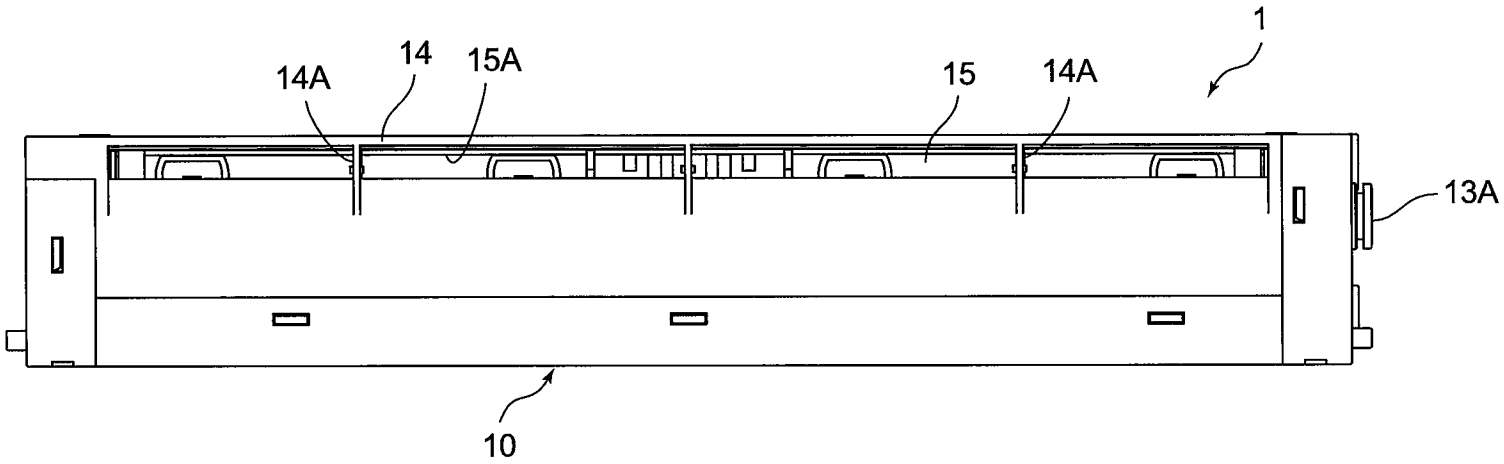
FIG. 5 is a rear view of the ion generator of FIG. 3.
Figure 10:
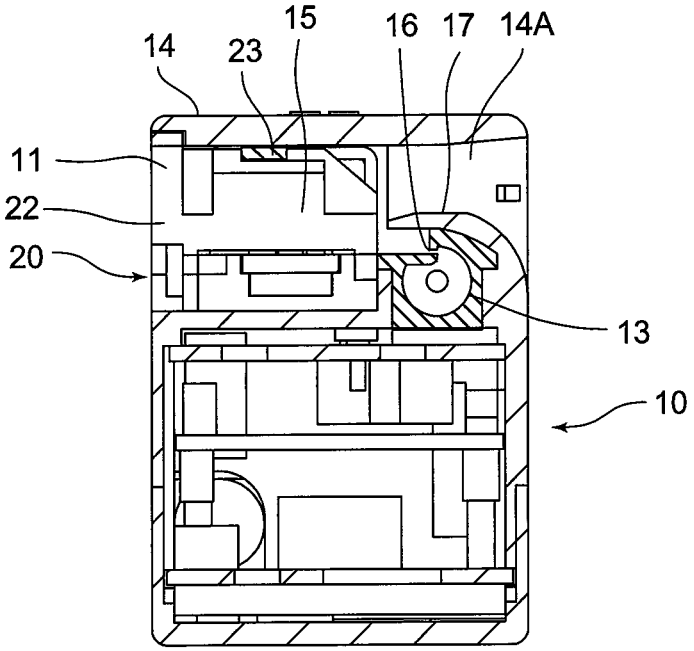
FIG. 10 is a cross-sectional view taken along the line 10-10 of FIG. 3.

As illustrated in FIG. 10, an air flow path 15 is formed among the cover 14, the first air supply passage 13, and the discharge electrode unit mounting portion 12. The air flow path 15 penetrates from the rear surface to the front surface of the housing 10, and is formed to be substantially parallel to the direction in which the air guide member 17 guides the ejected air. That is, the direction of the ejected air flow discharged from the first air discharge port 16 is the same as the direction of air flow flowing through the air flow path 15. The air flow path 15 abuts against the upper surface of the discharge electrode unit 20 assembled to the housing 10. As illustrated in FIGS. 2 and 5, an intermediate portion of the cover 14 is reinforced by reinforcing ribs 14A that are disposed in the housing 10 at intervals in the width direction.

As illustrated in FIGS. 2, 5, and 9, an inlet-hole 15A on the back side of the air flow path 15 is formed in a curved shape by the upper portion of the air guide member 17. Thus, the inlet-hole 15A on the back side of the air flow path 15 extends rearward. As a result, the outside air in the rear of the ion generator 1 is easily taken into the air flow path 15.

In addition, an opening area of the blow-off opening 11 of the ion generator 1 is the gross area of an opening area of the front surface of the air flow path 15, and an opening area of the opening portion 22.

As illustrated in FIG. 11, a plurality of discharge electrodes 21 is disposed side by side in the discharge electrode unit 20 at intervals in the lateral direction (width direction). Here, the four discharge electrodes 21 are illustrated in FIG. 11, but the number of the discharge electrodes 21 is not limited thereto. The discharge electrode 21 is formed in a thin linear shape or in a needle shape. In the state of mounting the discharge electrode unit 20 to the discharge electrode unit mounting portion 12, the discharge tip 21P of the discharge electrode 21 linearly extends toward the blow-off opening 11 on the front side. Moreover, groove-like opening portions 22 are formed on an upper portion of a counter electrode support 220, at positions corresponding to the positions of each of the discharge electrodes 21. The opening portion 22 penetrates in a front-to-back direction, and the top thereof is opened. Each of the discharge electrodes 21 is exposed to the outside from the upper surface of the counter electrode support 220 via the opening portion 22.

Figure 12:
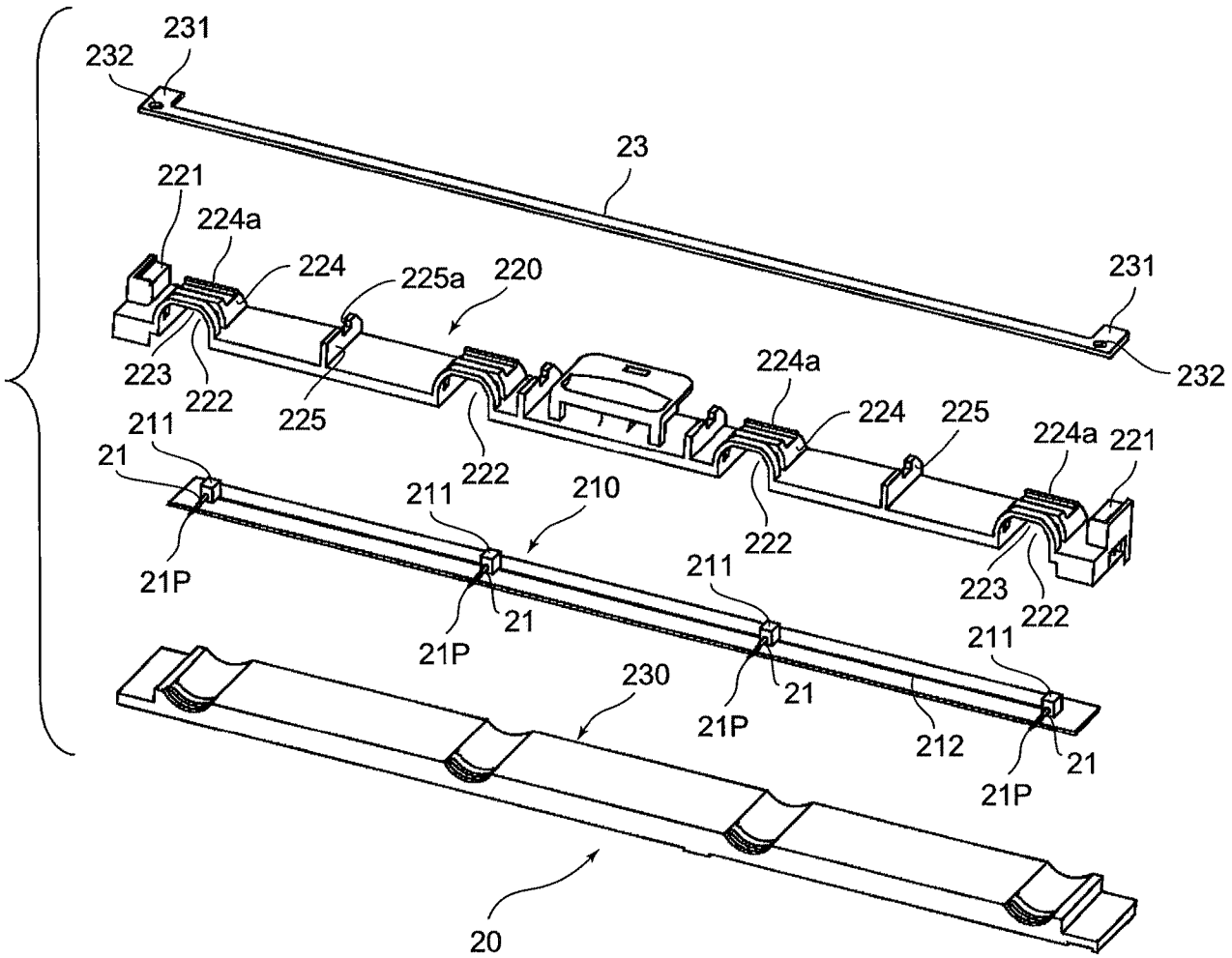
FIG. 12 is an exploded perspective view of the discharge electrode unit of FIG. 11.

As illustrated in FIGS. 9, 11 and 12, the counter electrode 23 is mounted to the discharge electrode unit 20, on the upper side of the position spaced rearward from the discharge tip 21P of the discharge electrode 21 by a predetermined distance. The counter electrode 23 is formed in a strip shape that is continuous in the longitudinal direction of the discharge electrode unit 20.

As illustrated in FIG. 12, the discharge electrode unit 20 has a discharge electrode support 210, and a counter electrode support 220. And, the counter electrode 23 is able to mount without difficulty on the counter electrode support 220 of the discharge electrode unit 20. The counter electrode 23 is mounted on the upper side of the position spaced rearward from the discharge tip 21P of the discharge electrode 21 by a predetermined distance.

The discharge electrode support 210 is formed by a rectangular printed circuit board. A discharge electrode holder 211 configured to hold the discharge electrode 21 is fixed to the upper surface of the printed circuit board, at a predetermined interval in the longitudinal direction. A pattern 212 provided on the printed circuit board is connected to each discharge electrode 21.

The counter electrode support 220 has approximately the same length as that of the discharge electrode support 210, and is formed of an insulating material such as synthetic resin. At both longitudinal ends of the counter electrode support 220, recesses 221 into which both longitudinal ends of the counter electrode 23 to be described later can be fitted are formed. An air guide opening portion 222 forming at least a part of the opening portion 22 is formed at positions corresponding to each of the discharge electrodes 21 of the discharge electrode support 210. The air guide opening portion 222 is formed by an opening edge 223. The opening edge 223 is an annular shape and formed as the lower side open. A flat roof-like spacer 224 covering the rear part of the upper surface of the air guide opening portion 222 is formed at the rear part of the opening edge 223. Recesses 224*a* are formed on the upper surface of the spacer 224, and the counter electrode 23 can be fitted to the recesses 224*a*. The spacer 225 has a thin rib shape and is provided between the spacers 224 adjacent to each other. Moreover, the height of the spacer 225 from the upper surface of the counter electrode support 220 is the same as the height of the spacer 224 from the upper surface of the counter electrode support 220. Recesses 225*a* are formed in the upper end portion of the spacer 225. The counter electrode 23 can be fitted to the recesses 225*a*. The recesses 221, the recesses 224*a*, and the recesses 225*a* are positioned on the common horizontal plane.

The counter electrode 23 is formed of a metal plate having conductivity. The surface of the counter electrode 23 is covered with an insulating material or an insulating film. As illustrated in FIGS. 11 and 12, fixing portions 231 are formed at both ends in the longitudinal direction of the counter electrode 23 and are extended in a direction perpendicular to the longitudinal direction.

The discharge electrode unit 20 having the above-described configuration can be assembled in the following manner. First, the discharge electrode support 210 is brought close to the lower side of the counter electrode support 220, while making the discharge electrode support 210 and the counter electrode support 220 in a parallel state. Subsequently, at least one of the discharge electrode support 210 and the counter electrode support 220 is moved in the parallel direction such that each of the discharge electrodes 21 is positioned at the center of each air guide opening portion 222 of the counter electrode support 220. Then, the upper surface of the discharge electrode support 210 is caused to abut against the lower surface of the counter electrode support 220, thereby positioning the discharge electrode 21 at a predetermined position.

In this state, the fixing portions 231 at both ends of the counter electrode 23 are fixed by being fitted into the recesses 221 at both ends of the counter electrode support 220. Alternatively, holes 232 are provided at both ends of the counter electrode 23, and the fixing portions 231 are fixed by being screwed into the counter electrode support 220 through the holes 232. When the fixing portions 231 of the counter electrode 23 are fixedly fitted to the recesses 221 of the counter electrode support 220, the counter electrode 23 is supported by the recesses 224*a* and 225*a* in a horizontal state. Accordingly, the shortest distances from the respective discharge electrode 21 to the counter electrode 23 are all the same, and discharge capability of each of the discharge electrodes 21 is the same.

After mounting the counter electrode 23 to the counter electrode support 220, a bottom member 230 is fixed to the bottom surface of the counter electrode support 220, and the bottom of the air guide opening portion 222 of the counter electrode support 220 is closed. When the discharge electrode support 210 is fixed to the counter electrode support 220, it is not necessary to use the bottom member 230.

As illustrated in FIG. 9, in the state in which the discharge electrode unit 20 is assembled to the housing 10, an ejected air flow path 24 is formed inside the discharge electrode unit 20. The ejected air flows toward the opening portion 22 from the front side of the first air discharge port 16 through the ejected air flow path 24. Thus, the ejected air discharged from the first air discharge port 16 is sent to the opening portion 22 through the ejected air flow path 24, flows between the counter electrode 23 and the discharge electrode 21, and is ejected forward from the blow-off opening 11. Accordingly, the air ions generated between the discharge electrode 21 and the counter electrode 23 are efficiently ejected forward by the ejected air.

Referring again to FIG. 9, a spacing portion 26 is provided between the front leading end portion of the air guide member 17 and the trailing end portion of the ejected air flow path 24. As described above, the ejected air from the first air discharge port 16 flows through the ejected air flow path 24 at a high speed. Moreover, in the spacing portion 26 and the opening portion 22, the ejected air flowing at a high speed joins the outside air in the air flow path 15.

In addition, as illustrated in FIGS. 1 and 2, the ion generator 1 is supplied with power source from an external power source via a power cable 27. And high voltage is applied between the two electrodes of the discharge electrode 21 and the counter electrode 23 incorporated in the discharge electrode unit 20. Thus, a corona discharge occurs, and the air ions are generated. Since the structures of an internal wiring, a circuit configuration and the like for supplying the power source (not illustrated) are well known, the detailed description thereof will not be provided.

Figure 6:
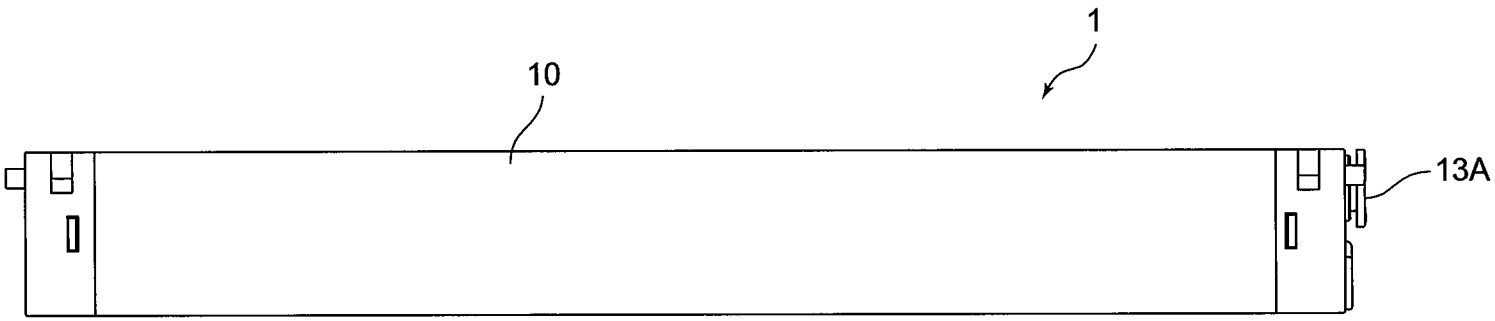
FIG. 6 is a bottom view of the ion generator of FIG. 3.
Figure 7:
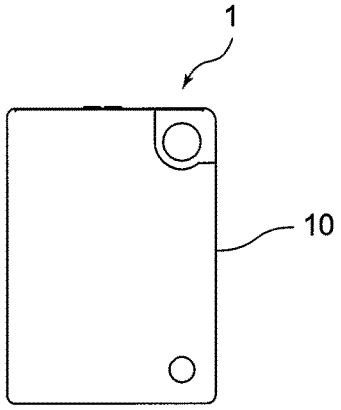
FIG. 7 is a right side view of the ion generator of FIG. 3.

Next, the operation of the ion generator 1 according to the embodiment will be described with reference to FIGS. 9 and 10. The compressed air supplied from the air supply port 13A (FIGS. 6 and 8) of the housing 10 flows into the first air supply passage 13, and is blown out from the first air discharge port 16. Moreover, the blown ejected air flows into the opening portion 22 in which the discharge electrode 21 and the counter electrode 23 faces each other, through the ejected air flow path 24, and is blown out from the blow-off opening 11, together with the air ions generated by the corona discharge.

The high-speed ejected air blown from the first air discharge port 16 takes in the outside air at the air flow path 15 or the rear part of the ion generator 1 via the spacing portion 26, thereby generating the flow of outside air different from the flow of ejected air. More particularly, the flow of the ejected air comes into contact with the outside air in the vicinity of the opening portion 22 of the discharge electrode unit 20. Moreover, the outside air is taken in the flow of ejected air. Thus, the outside air flows along the flow of the ejected air.

Figure 15A:
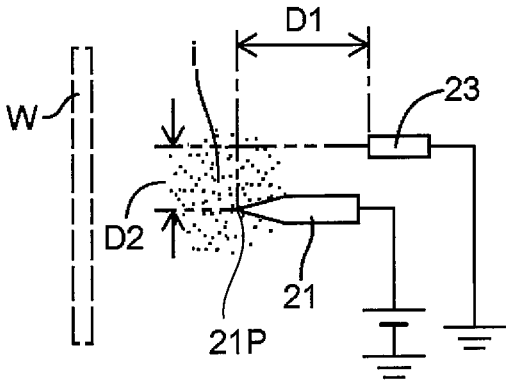
FIGS. 15A and 15B are diagrams illustrating a difference between a comparative example and the present invention in regard to the arrangement of the discharge electrode and the counter electrode.
Figure 15B:
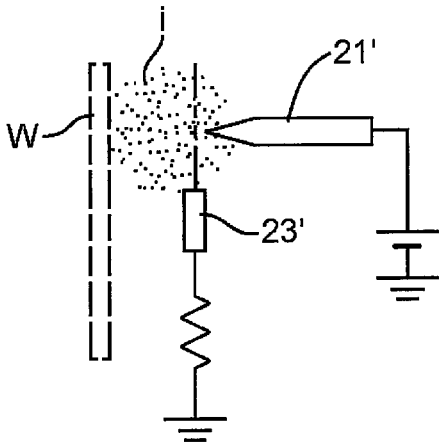

As illustrated in FIG. 15B, a counter electrode 23' is formerly disposed on the front side of or around the discharge tip of the discharge electrode 21'. In contrast, in the present invention, illustrated in FIG. 15A, the counter electrode 23 is disposed at a position spaced rearward from a discharge tip 21P of the discharge electrode 21 by a predetermined distance D1 and upward by a predetermined distance D2. In the present invention, the electric field intensity generated between the discharge electrode 21 and the counter electrode 23 is approximately 10 to 20% low compared to the electric field intensity generated between the discharge electrode 21' and the counter electrode 23'.

However, the counter electrode 23 is located on the upstream side of the flow of ejected air with respect to the discharge electrode 21. Thus, in the total amount of air ions generated around the discharge tip 21P of the discharge electrode 21, the amount adsorbed to the counter electrode 23 is small. More specifically, the corona discharge occurs in the space between the discharge tip 21P of the discharge electrode 21 and the counter electrode 23 provided behind the discharge tip 21P. The air flows toward the front from the discharge tip 21P of the discharge electrode 21. Therefore, the air ions do not flow rearward from the discharge tip 21P, that is, to the upstream side of the flow of air. As a result, in the total amount of air ions, the amount adsorbed to the counter electrode 23 is small.

Since the counter electrode 23 is covered with an insulating film, current due to air ions does not flow to the counter electrode 23. And, since the counter electrode 23 is not grounded via a resistor, the potential of the counter electrode 23 does not change. As a result, since the electric field intensity between the discharge electrode 21 and the counter electrode 23 does not change so much, it is possible to suppress a change in the generation amount of air ions. Therefore, it is possible to carry the air ions to the target without disturbing the balance between the air ions. That is, it is possible to increase a conveyance amount of ion without affecting the generation amount of air ions.

As described above, the present invention can have a configuration in which air effectively flows. The outside air flowing into the ion generator 1 is blown off together with the air ions generated by the discharge electrode 21, by coming contact with the discharge electrode 21 at the opening portion 22 of the discharge electrode unit 20. At this time, the counter electrode 23 is disposed on the upper side of the discharge electrode 21. Therefore, the taken outside air is blown out, while passing through the upper portion of the discharge electrode 21, and while taking the air ions to be generated in the discharge electrode 21. In this way, since the air volume of outside air is applied in addition to the air volume of the ejected air to be blown out, an amount of ion-conveying air is amplified.

The cover 14 of the housing 10 also has a function of regulating the flow of the taken outside air. That is, since the flow of outside air flowing into the air flow path 15 is regulated by the cover 14, turbulence does not occur. If the turbulence occurs, the positive air ions and the negative air ions are neutralized each other by mixing of turbulence. However, since it is possible to prevent the occurrence of turbulence by the cover 14, it is possible to reduce the neutralization of the air ions. Furthermore, when the turbulence occurs, straightness of the flow of outside air is lost. Moreover, the flow rate of the outside air is lowered. The cover 14 can prevent these problems.

The ion generator 1 has the air guide member 17 that guides the ejected air blown out from the first air discharge port 16 toward the opening portion 22. Moreover, the ejected air is sent to the opening portion 22 while remaining at a high speed. As a result, since the outside air is easily taken by the flow of the high-speed ejected air, the ion generator 1 is able to blow out the ion-conveying air exceeding the flow rate of the ejected air from the blow-off opening 11.

The ion generator according to the embodiment of the present invention has been described above, but the present invention is not limited to the above-described embodiments, and various modifications and alternations can be made based on the technical idea of the present invention.

For example, in this embodiment, the counter electrode 23 is provided above the rear part of the discharge electrode 21, but the counter electrode 23 may be provided below the rear part of the discharge electrode 21, by reversing a vertical relation between the discharge electrode 21 and the counter electrode 23. Otherwise, the counter electrode 23 may be formed in an annular shape centered on a rear extension line of the axial center of the discharge electrode 21.

Figure 16:
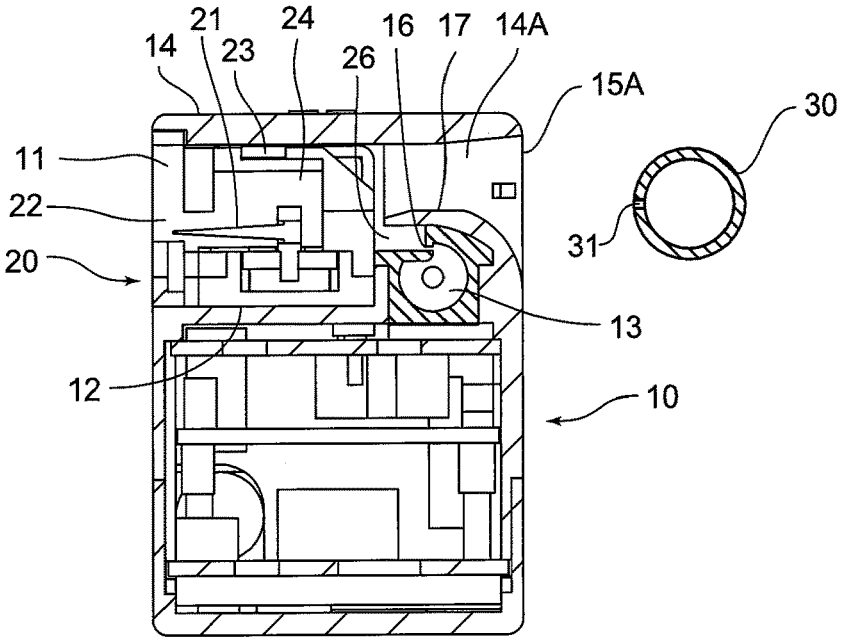
FIG. 16 is a diagram illustrating a second air supply portion.

In this embodiment, the outside air is sent to flow through the air flow path 15 so as to be taken into the high-speed ejected air. In contrast, for example, as illustrated in FIG. 16, it is also possible to add a second air supply portion 30 configured to supply the assist air on the upstream side of the first air discharge port 16.

The second air discharge port 31 of the second air supply portion 30 is directed toward the air flow path 15. The air spouted from the second air discharge port 31 flows with the outside air to a region (i.e., air ions generating space) where the air ions are generated between the discharge electrode 21 and the counter electrode 23. The air volume of outside air flowing through the air flow path 15 further increases (assists), by the assist air blown out from the second air discharge port 31. As a result, a larger amount of the ion-conveying air (the ejected air, the outside air, and the assist air) is obtained. Furthermore, straightness of the outside air flow is further enhanced by sending the assist air into the air flow path 15.

Furthermore, in this embodiment, air, that is, air obtained by combining the ejected air with the outside air, or air obtained by combining the ejected air, the outside air, and the assist air is caused to flow between the discharge electrode 21 and the counter electrode 23, but this flow of air is not always necessary. The flow of air is required when the voltage applied to the discharge electrode is high-frequency AC voltage, but it is not necessary to cause the air to flow when the applied voltage is low-frequency AC voltage.

The counter electrode 23 is further preferably provided with an insulating material that covers the same. Since the insulating film is easy to be provided, the insulating film is desirably used for the insulating material. When the counter electrode 23 is covered with an insulating material, since the adsorption of air ions to the counter electrode 23 is prevented, the electric charge is prevented from being accumulated in the counter electrode 23. Erosion of the counter electrode 23 due to air ions also does not occur. Using the insulating material obtains an effect in which a conveyance amount of air ions generated increases without a decline in the discharge capacity.

Figure 17:
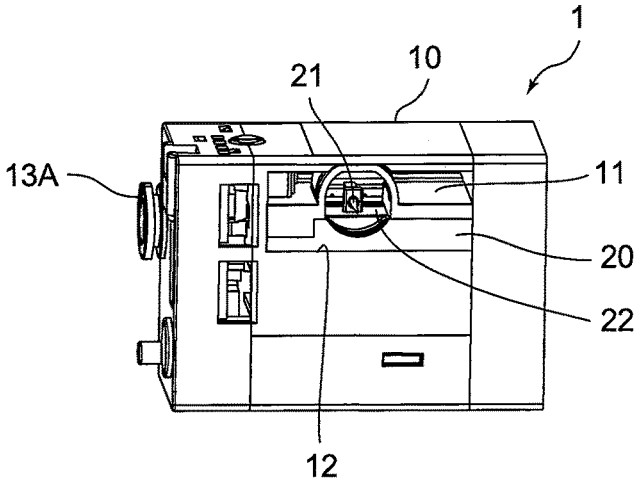
FIG. 17 is an overall perspective view in which an ion generator according to another embodiment of the present invention is viewed from the front side.

The above-described embodiments relates to the ion generator 1 in which a plurality of the discharge electrodes 21 is provided in the longitudinal direction, but, in contrast, for example, as illustrated in FIG. 17, the ion generator may be in the form that is provided with one discharge electrode 21 and one counter electrode 23, and blows the air ions to the target in a spot manner. In FIG. 17, members corresponding to the members of the above-described embodiment are denoted by the same reference numerals.

Although various embodiments of the present invention have been described and shown, the invention is not restricted thereto, but may also be embodied in other ways within the scope of the subject-matter defined in the following claims.

What is claimed is:

1. An ion generator that sends out air ions generated by applying a high voltage between a discharge electrode and a counter electrode, comprising:

a housing formed with an air discharge port through which ejected air is sent toward the discharge electrode and an opening portion through which the generated air ions are discharged together with the ejected air; and a discharge electrode unit detachably attached to the housing, the discharge electrode unit having a discharge electrode support provided with an electrode holder configured to hold the discharge electrode and a counter electrode support having a spacer formed with a recess into which the discharge electrode is fitted, wherein the counter electrode is positioned on an upstream side of the flow of the ejected air with respect to a discharge tip of the discharge electrode.

2. The ion generator according to claim 1, wherein the counter electrode support is provided with an air guide opening portion forming at least part of the opening portion, wherein the air guide opening portion occupies a position corresponding to the discharge electrode of the discharge electrode support.

3. The ion generator according to claim 1, wherein the discharge electrode support has spacers formed with respective recesses which are provided on a plane.

4. The ion generator according to claim 1, wherein the counter electrode has a plate-like structure.

5. The ion generator according to claim 1, further comprising: a second air supply member provided to a rear side of the housing, and configured to supply outside air to an air ions generating space between the discharge electrode and the counter electrode.

6. The ion generator according to claim 5, wherein the housing is provided with a cover configured to regulate the flow of outside air to be supplied to the air ions generating space between the discharge electrode and the counter electrode.

7. The ion generator according to claim 1, further comprising: an air guide member extending in a front direction so as to cover an upper front side of the air discharge port, thereby guiding the ejected air to the opening portion.

* * * * *